US005115873A

United States Patent [19]

Pastusek

[11] Patent Number: 5,115,873

[45] Date of Patent: May 26, 1992

[54] METHOD AND APPARTUS FOR DIRECTING DRILLING FLUID TO THE CUTTING EDGE OF A CUTTER

[75] Inventor: Paul E. Pastusek, Salt Lake City, Utah

[73] Assignee: Baker Hughes Incorporated, Houston, Tex.

[21] Appl. No.: 645,558

[22] Filed: Jan. 24, 1991

[51] Int. Cl.[5] ..... E21B 10/46; E21B 10/60

[52] U.S. Cl. ..... 175/65; 175/329; 175/393; 175/410; 175/429; 175/430

[58] Field of Search ..... 175/329, 330, 393, 339, 175/340, 410

[56] References Cited

U.S. PATENT DOCUMENTS

| | | | |
|---|---|---|---|
| 2,357,835 | 9/1944 | Leissler | 175/393 |
| 4,098,363 | 7/1978 | Rohde et al. | 175/329 |
| 4,200,159 | 4/1980 | Peschel et al. | 175/329 |
| 4,285,409 | 8/1981 | Allen | 175/336 |
| 4,303,136 | 12/1981 | Ball | 175/329 |
| 4,341,273 | 7/1982 | Walker et al. | 175/339 |
| 4,352,400 | 10/1982 | Grappendorf et al. | 175/330 |
| 4,373,593 | 2/1983 | Phaal et al. | 175/329 |
| 4,452,324 | 6/1984 | Jurgens | 175/393 |
| 4,460,053 | 7/1984 | Jurgens et al. | 175/329 |
| 4,471,845 | 9/1984 | Jurgens | 175/329 |
| 4,540,056 | 9/1985 | O'Hanlon | 175/393 |
| 4,606,418 | 8/1986 | Thompson | 175/329 |
| 4,682,663 | 7/1987 | Daly et al. | 175/329 |
| 4,852,671 | 8/1989 | Southland | 175/329 |
| 4,883,132 | 11/1989 | Tibbitts | 175/65 |
| 4,902,073 | 2/1990 | Tomlinson et al. | 175/393 X |
| 4,913,244 | 4/1990 | Trujillo | 175/65 |

FOREIGN PATENT DOCUMENTS

| | | |
|---|---|---|
| 903059 | 2/1986 | Belgium . |
| 2391350 | 5/1978 | France . |

*Primary Examiner*—Stephen J. Novosad
*Attorney, Agent, or Firm*—Michael Polacek

[57] ABSTRACT

The present invention discloses an apparatus and method for directing drilling fluid to the cutting tip of a downhole drilling bit cutter by one or more flow channels formed in the upper section of the cutter's front surface, thereby maximizing the cleaning and cooling effect of the fluid flow on the actual cutting surface. Another embodiment of the present invention discloses an apparatus and method for helping to peel a rock chip from the face of a downhole drilling bit cutter while simultaneously cleaning and cooling the drill bit cutter cutting tip.

21 Claims, 6 Drawing Sheets

METHOD AND APPARTUS FOR DIRECTING DRILLING FLUID TO THE CUTTING EDGE OF A CUTTER

BACKGROUND OF THE INVENTION

This invention is related to the field of earth boring tools, and in particular to a method and apparatus for directing drilling fluid to the cutting edges of various downhole drilling bit cutters, most likely polycrystalline diamond cutters (PDCs). More particularly, this invention discloses the invention of a channeling system in the upper part of a cutter's front surface which focuses the drilling fluid flow right at the cutting tip of the cutter, thereby maximizing the cleaning and cooling effect of the fluid flow on the actual cutting surface.

In the past, drilling fluid has generally been introduced to the face of a bit through passageways or nozzles in a bit. The drilling fluid would flow around the bit, more particularly the cutting face of the bit, thereby cooling the bit and washing the cutting elements so that they would present a clean cutting face. The drilling fluid would then move the cuttings to the gauge of the bit and there lift them up the annulus between the drill string and the wall of the bore hole.

For example, U.S. Pat. No. 4,098,363 discloses a design of a bit where the nozzles are positioned in the junk slots in the face of the bit with their axes oriented and so distributed across the face of the bit that the ejected streams of drilling fluid wash over the cutters and cover substantially the entire surface of the formation being cut by the bit when the bit is rotated. The longitudinal arrays of cutters therein are separated by the junk slots which also serve as water courses. The arrays of nozzles within the drill bit fluid channels produce a fluid flow of such velocity that bit cleaning and detritus removal is facilitated.

In order to improve the cleaning and detritus removal action of the drilling fluid flow from such nozzles, specific nozzle arrays and directions have been proposed and used in the design of drilling bits. For example, as disclosed in U.S. Pat. No. 4,471,845, the outlet cones of nozzles have been so dimensioned that all the cutting elements on a drill bit have been supplied with flushing fluid flow. Furthermore, the alignment of the nozzles has been varied depending on which direction of the flushing stream is desired with regard to optimum cutting bit cooling and cutting removal action. As further disclosed in U.S. Pat. No. 4,471,845, certain nozzles have been aligned so that they impress a direction tangential to the drill bit towards the cutting elements on the flushing stream, whereas other nozzles have been aligned to impress a radial component towards the marginal region of the bit on the flushing stream.

The fluid nozzles in a drill bit, as shown in U.S. Pat. No. 4,452,324, have also been variously curved and thereby their flow directed towards the cutting members. This alignment gives the jets of the flushing fluid emerging from the curved nozzles an alignment with at least one component facing in the direction of the drillings flowing off along the outer face of the body.

Furthermore, bits have also been designed with a multiplicity of individual diamond insert studs which include an axially aligned fluid passage formed within the insert stud which communicates with a fluid-filled chamber formed by the drag bit. The fluid exits the passage in the stud in front of the diamond cutting face of the stud to assure cooling and cleaning of each insert stud inserted in the face of the drag bit. One such design is disclosed in U.S. Pat. No. 4,303,136.

In one development, as disclosed in U.S. Pat. No. 4,606,418, the discharge nozzle is actually placed within the cutting face itself and directs drilling fluid away from the cutting face and into the formation to be cut. There are, however, associated problems with this development such as the clogging of the nozzle by the formation and ineffective cooling of the cutter cutting tip.

In another development, as disclosed in U.S. Pat. No. 4,852,671, the cutting disc edge and the leading end of the stud the disc is mounted on include a channel meant to conduct cooling fluid to the cutting points to clean and cool the same. These two cutting edge segments, however, wear at a faster rate than the usual single cutting edge and the channel could clog and thereby become ineffective for conducting cooling fluid.

In some recent improvements, such as that disclosed in U.S. Pat. No. 4,883,132, hydraulic nozzles are defined in the bit body beneath and azimuthally behind the arches formed by each blade. The nozzles direct hydraulic flow across the cavity under the arch and across each portion of the cutting face on the arch. As a result, when cutting, substantially only a diamond surface is provided for shearing a rock formation or contacting with velocity any portion of the plastic rock formation. Once the rock chip is extruded upwardly across the diamond face of the cutter, it is subjected to a directed hydraulic flow which peels the chip from the diamond face and transports it into the open cavity designed underneath the arch blade.

In an even more recent improvement, as disclosed in U.S. Pat. No. 4,913,244, an improved rotating drag bit for cutting plastic, sticky, water reactive, and shell formations is devised wherein each large cutter is provided with at least one hydraulic nozzle which in turn provides a directed hydraulic flow at the corresponding cutter face. The directed hydraulic flow is positioned to apply a force to the chip which tends to peel the chip away from the cutter face. In addition, the hydraulic flow is positioned with respect to the chip so as to apply an off-center torque to the chip which is used to peel the chip away from the cutter face and toward the gauge of the bit.

As one can see from the above description of the prior art, in most current dedicated hydraulic bit designs, a fluid stream is directed at the flat face of a cutter. Upon hitting this face, the fluid flow spreads out over the surface. The spreading out of the flow is not controlled in any way and, therefore, certain portions of the cutting face of the cutter may get more or less flow depending on the nozzle direction and conditions down hole. However, it is the actual cutting tip of the cutter which needs the maximum cooling and cleaning action of the fluid flow in order for the drill bit as a whole to function most efficiently and economically.

BRIEF SUMMARY OF THE INVENTION

The present invention discloses a novel design of a downhole drilling bit cutter front surface which maximizes the flow of the drilling fluid at the actual cutting tip of the cutter. This fluid flow maximization and focusing is accomplished by the creation of a channeling system in the upper part of the cutter front surface whereby the drilling fluid flow is focused right at the cutting tip of the cutter, thereby maximizing the cleaning and cooling of the actual cutting surface. In another embodiment of the present invention, a portion of the drilling fluid flow is focused at the rock chip as it is extruded upwardly across the diamond face of the cutter to peel the chip away from the diamond face.

DETAILED DESCRIPTION OF THE PRESENT INVENTION

The present invention will now be described in greater detail and with specific references to the accompanying drawings.

Figure 1:
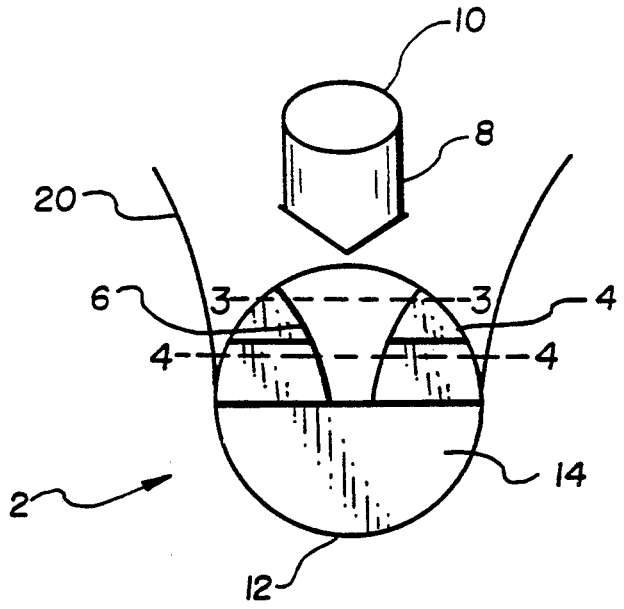
FIG. 1 is a front view of a PDC designed according to one embodiment of the present invention.
Figure 2:
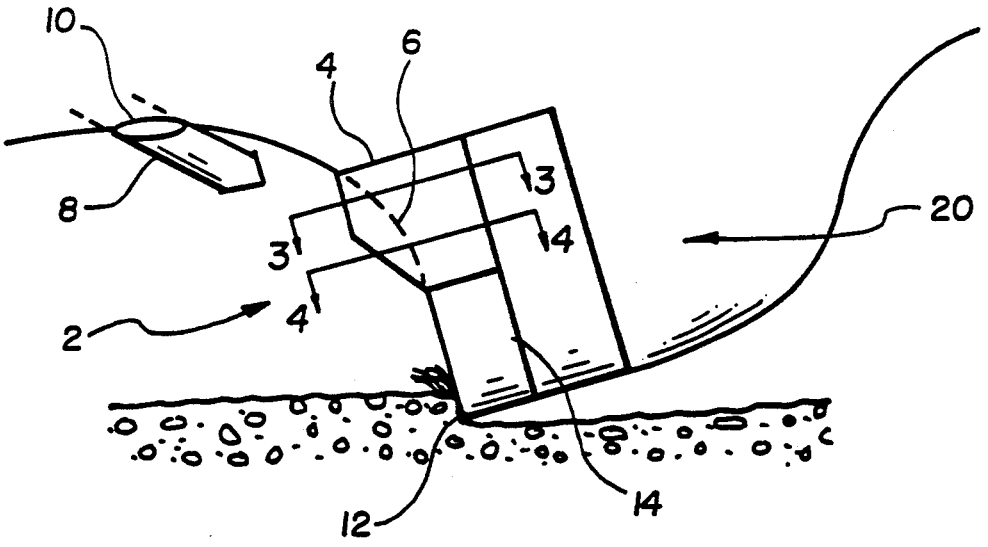
FIG. 2 is a side view of the PDC shown in FIG. 1.

With reference now to FIGS. 1 and 2, a PDC designed according to one embodiment of the present invention is shown. As shown in FIG. 1, the PDC 2 includes an upper section 4. In turn, the upper section 4 includes a channel 6. This channel 6 is designed to accept the fluid flow 8 from fluid nozzle 10 and direct the flow 8 to the cutting tip 12 of the lower section 14 of the PDC 2. The design of a drill bit fluid nozzle is well known in the art and a number of such nozzle designs could be utilized in the present invention, depending on specific drill bit and formation requirements.

Figure 3:
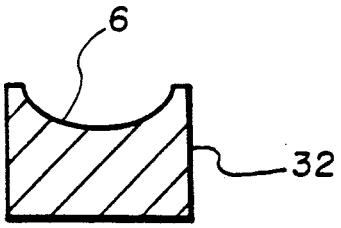
FIG. 3 is a cross-sectional view of the PDC shown in FIGS. 1 and 2 along line 33.
Figure 4:
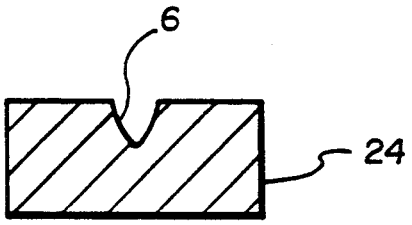
FIG. 4 is a cross-sectional view of the PDC shown in FIGS. 1 and 2 along line 44.

As more clearly shown in FIG. 2, the PDC 2 is mounted within bit body matrix 20. With reference now to FIG. 3, a cut-away view of the flow channel 6 is shown. In contrast with FIG. 4, the upper section 22 of flow channel 6 is generally shallower and wider than the lower section 24 of flow channel 6. The reason behind this contour difference is that as the flow channel 6 narrows and deepens, the flow of the drilling fluid is more forcefully and directly focused towards the cutting tip 12 of the PDC.

Figure 5:
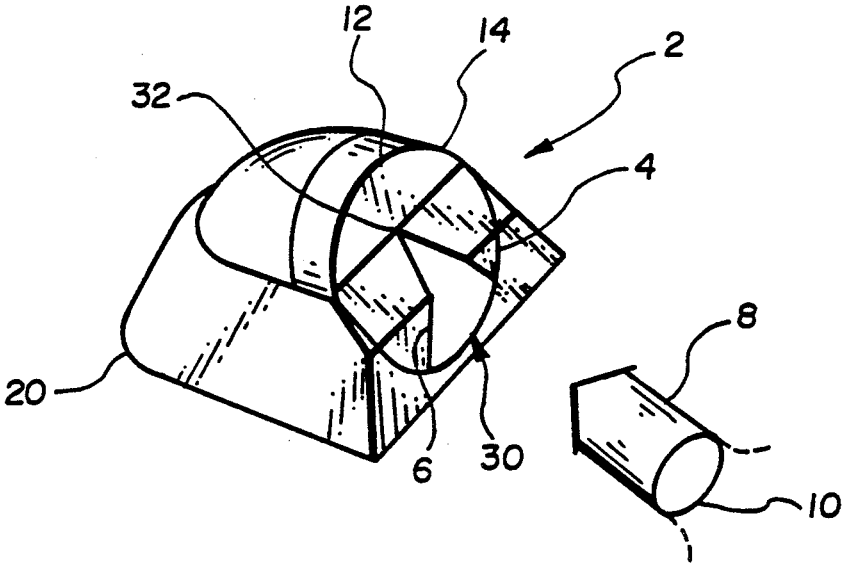
FIG. 5 is a perspective view of the PDC shown in FIG. 1.

With reference now to FIG. 5, a perspective view of the PDC of FIG. 1 is shown. As described hereinabove and as shown in FIG. 5, the flow channel 6 accepts the fluid flow 8 from nozzle 10 at the channel's 6 wide and shallow end 30 and through its contour directs and focuses the flow 8 through its deeper and narrower end 32 towards the cutting tip 12 of the PDC 2. As one can see from FIGS. 1-5, the upper section 4 of the PDC 2 is generally chamfered in order to present a flatter, less breakage prone face to the formation.

Figure 11:
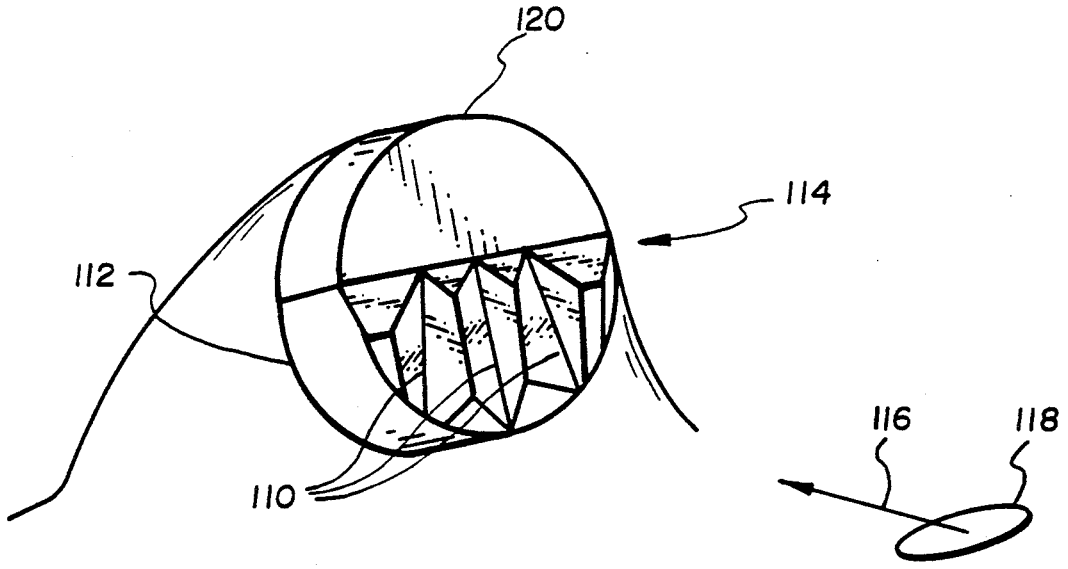
FIG. 11 is a perspective view of a PDC designed according to yet another embodiment of the present invention.

Furthermore, as shown in FIG. 11, more than one flow channel 110 can be formed in the upper section 112 of the PDC 114. As shown in FIG. 11, the flow channels 110 receive the fluid flow 116 from the nozzle 118 and channel the same towards the cutting tip 120 of the PDC 114.

Figure 12:
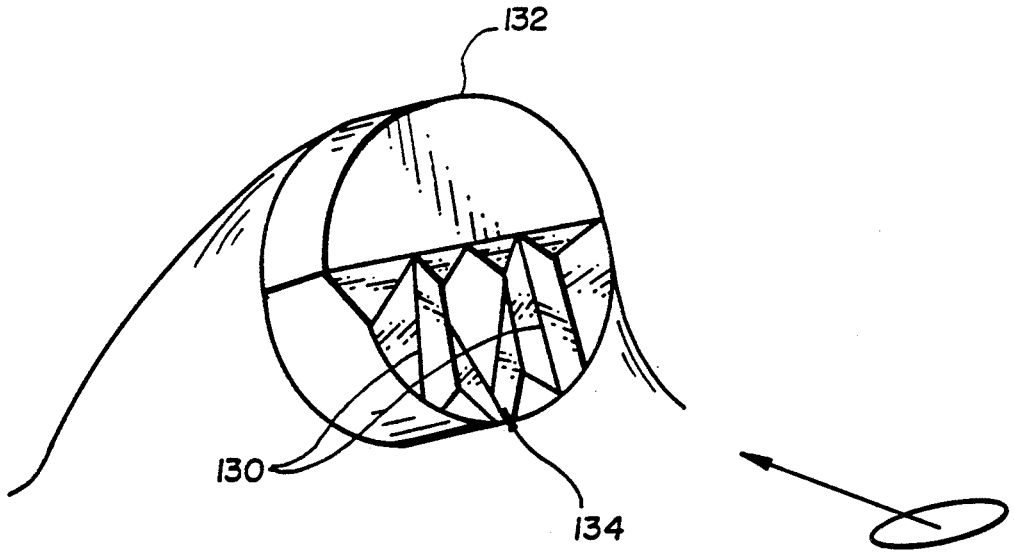
FIG. 12 is a perspective view of a PDC designed according to still another embodiment of the present invention.
Figure 13:
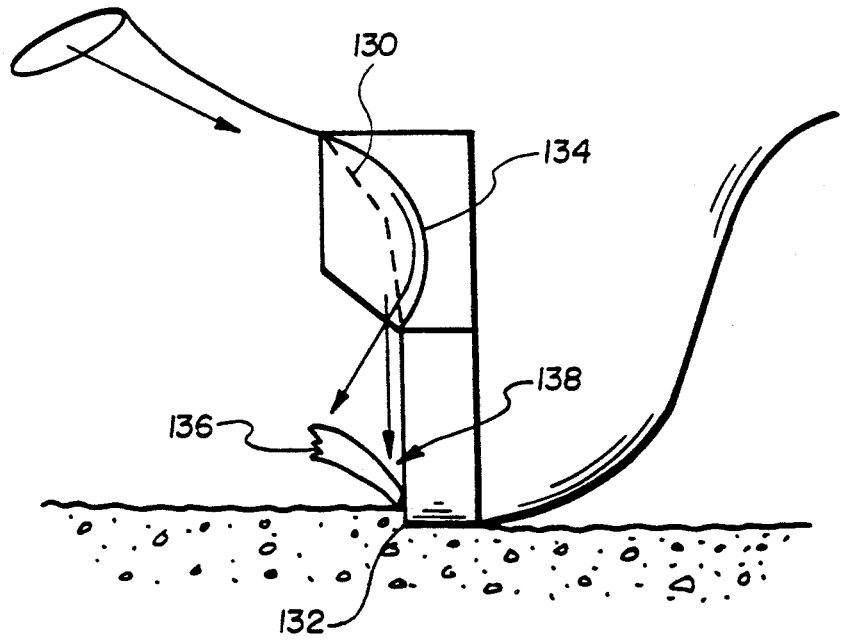
FIG. 13 is a side view of the PDC shown in FIG. 12.

In another embodiment of the multiple channel system, one or more of the channels would funnel a portion of the fluid flow to the cutter tip while one or more of the channels would direct a portion of the fluid flow at the rock chip as it is being extruded upwardly across the diamond face. Such a design is shown in FIGS. 12 and 13. As seen in FIGS. 12 and 13, the outer two flow channels 130 direct their fluid flow at the cutter tip 132 while the middle channel 134 directs its flow towards the rock chip 136 as it is extruded across the diamond face 138.

The simple design of the present invention, as discussed in detail hereinabove, indicates that such a flow channel system design would be suitable for a large variety of cutter and matrix designs. For example, PDC or non-PDC cutters and stud cutters or cutters mounted directly into the bit body matrix could all be designed with such a flow channel. Furthermore, various sizes of cutters, from small cutters to large cutters, could utilize the design of the present invention.

Likewise, the exact design of the flow channel system can be varied depending on the needs of a specific drill bit cutter and the formations for which it is designed. For example, the flow channel or channels could be designed with various contour profiles thereby varying the exact focus of the flow depending on the formation which will be cut by the cutter. More particularly, a hard formation would generally indicate the need for a precisely focused fluid flow, whereas a softer formation cut by larger cutters would generally require a wider area of cut and thereby a correspondingly wider focus of the flow.

Figure 6:
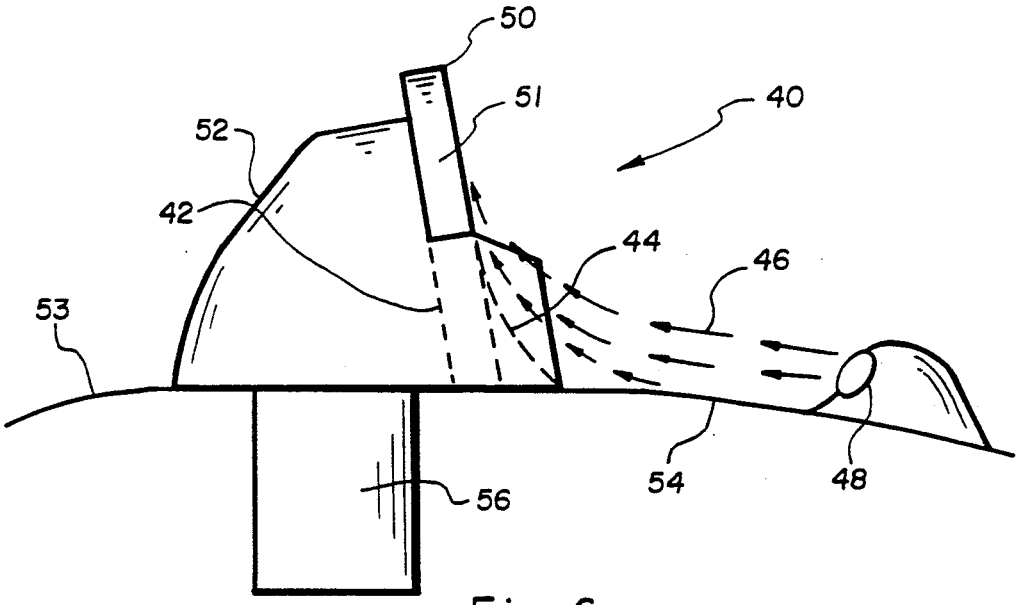
FIG. 6 is a side view of a PDC and stud combination designed according to another embodiment of the present invention.

For example, and with reference to FIG. 6, a side view of a PDC and stud combination designed according to yet another embodiment of the present invention is shown. As seen in FIG. 6, the PDC 40 includes an upper section 42 which in turn includes a flow channel 44. The flow channel 44 is designed to accept the fluid flow 46 from fluid nozzle 48 and direct the flow 46 to the cutting tip 50 of the PDC 40. The PDC 40 in this embodiment includes a backing 52 and a stud 56 which is mounted within the bit body matrix 53 and flush with the bit face 54. The fluid nozzle 48 is likewise mounted within the bit body matrix 53.

Figure 7:
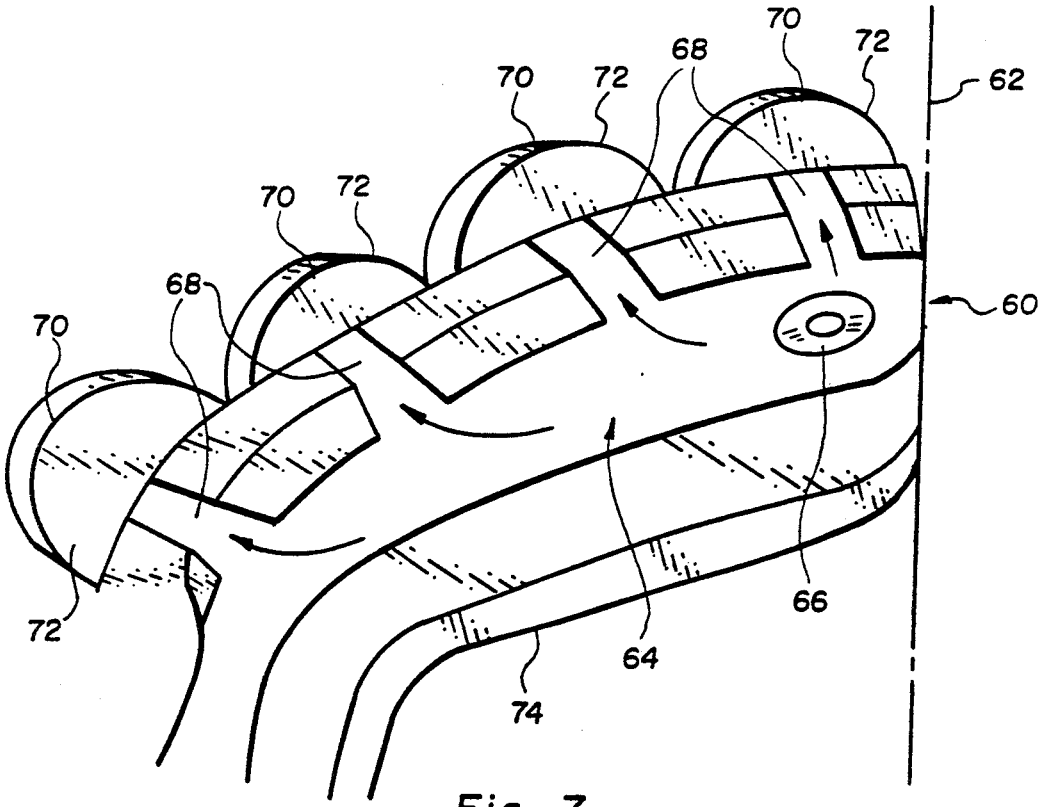
FIG. 7 is a perspective view of a section of a downhole bit and cutter combination designed according to still another embodiment of the present invention.

Yet a further embodiment of the present invention is shown in FIG. 7. FIG. 7 shows one section 60 of a downhole drill bit and cutter combination. The bit section 60 revolves around the bit central axis 62 and includes a drilling fluid course 64. The drilling fluid enters the course 64 via nozzle 66 mounted towards the central axis 62 of the bit. The design and contour of the fluid course 64, in combination with the centrifugal effect of the rotating bit, forces the drilling fluid which enters the course 64 from the nozzle 66 radially away from the bit central axis 62. In turn, the rotation of the bit forces the drilling fluid against the flow channels 68 which accept the fluid flow from the course 64 and direct it towards the cutting tips 70 of the respective PDCs 72.

As shown in FIG. 7, the PDCs 72 are mounted within the bit matrix 74 in such a way that only about one-half of each PDC 72 extends out beyond the bit body matrix 74. Of course, the exact mounting of the PDCs within the bit body matrix is based on design choice and various mountings of the same are well known in the art and could be utilized in this embodiment of the present invention. For example, thermally stable PDCs could be furnaced into the body matrix itself while non-thermally stable PDCs could be brazed into formed pockets within the bit body matrix after furnacing of the bit. Likewise, PDCs could be mounted on a stud for easy replacement.

Figure 8:
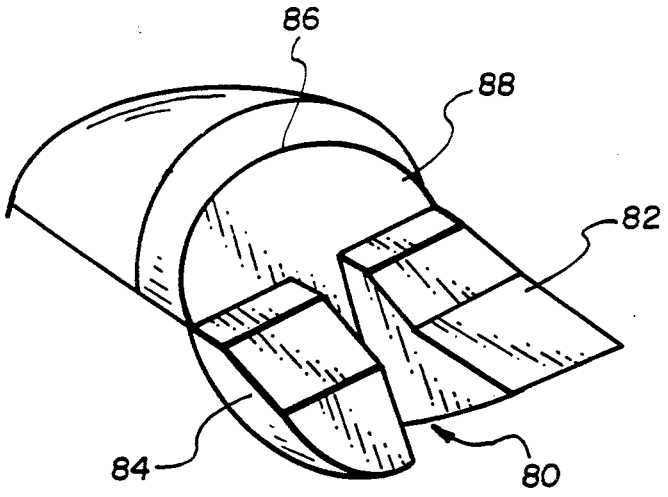
FIG. 8 is a perspective view of one PDC flow channel design for use with the drill bit and cutter combination embodiment shown in FIG. 7.
Figure 9:
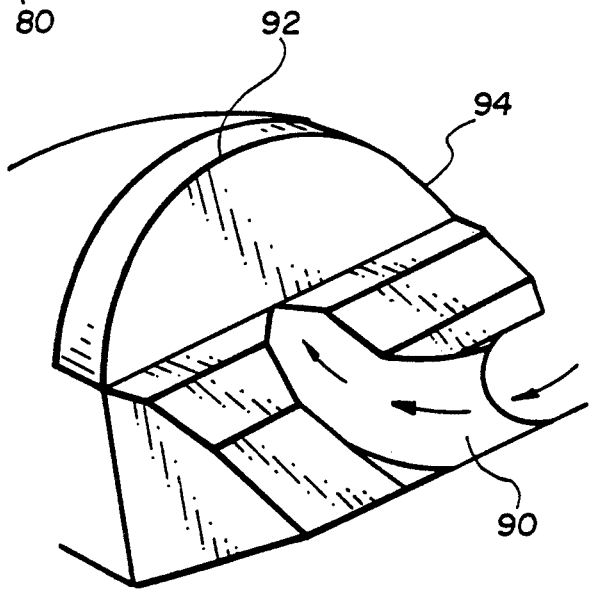
FIG. 9 is a perspective view of another PDC flow channel design for use with the drill bit and cutter embodiment shown in FIG. 7.
Figure 10:
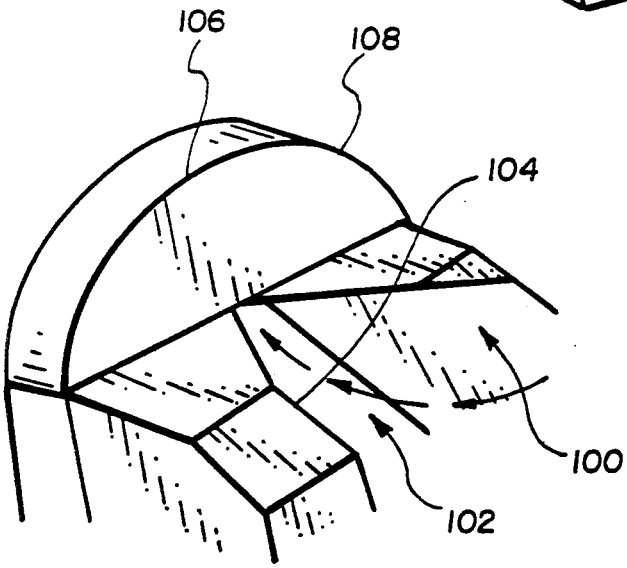
FIG. 10 is a perspective view of yet another PDC flow channel design for use with the drill bit and cutter embodiment shown in FIG. 7.

Furthermore, and as shown in FIGS. 8–10, the flow channels 68 could have varying contours and designs depending on the specific application of each bit. In one example, as shown in FIG. 8, the flow channel 80 is formed by two projections 82 and 84. The projection 82 would be closer to the drilling fluid outlet and thereby also the central bit axis. As shown in FIG. 8, the projection 82 is formed in a plow shape which would direct the drilling fluid into the channel 80 wherein it would be forced against the projection 84 and forced towards the cutting tip 86 of the PDC 88.

In yet another flow channel design for use with the drill bit and the cutter combination embodiment shown in FIG. 7, and as shown in FIG. 9, the flow channel 90 is formed in a curved fashion which would accept the drilling fluid flowing through the course and force it towards the cutting tip 92 of the PDC 94. Still, in another version of a flow channel design for use with the embodiment shown in FIG. 7, and as shown in FIG. 10, the near contour 100 of the flow channel 102 closest to the central axis of the bit would be angled while the outer channel contour 104 would form a scooped region where the fluid stream would again be forced towards the cutting tip 106 of the PDC 108.

Figure 14:
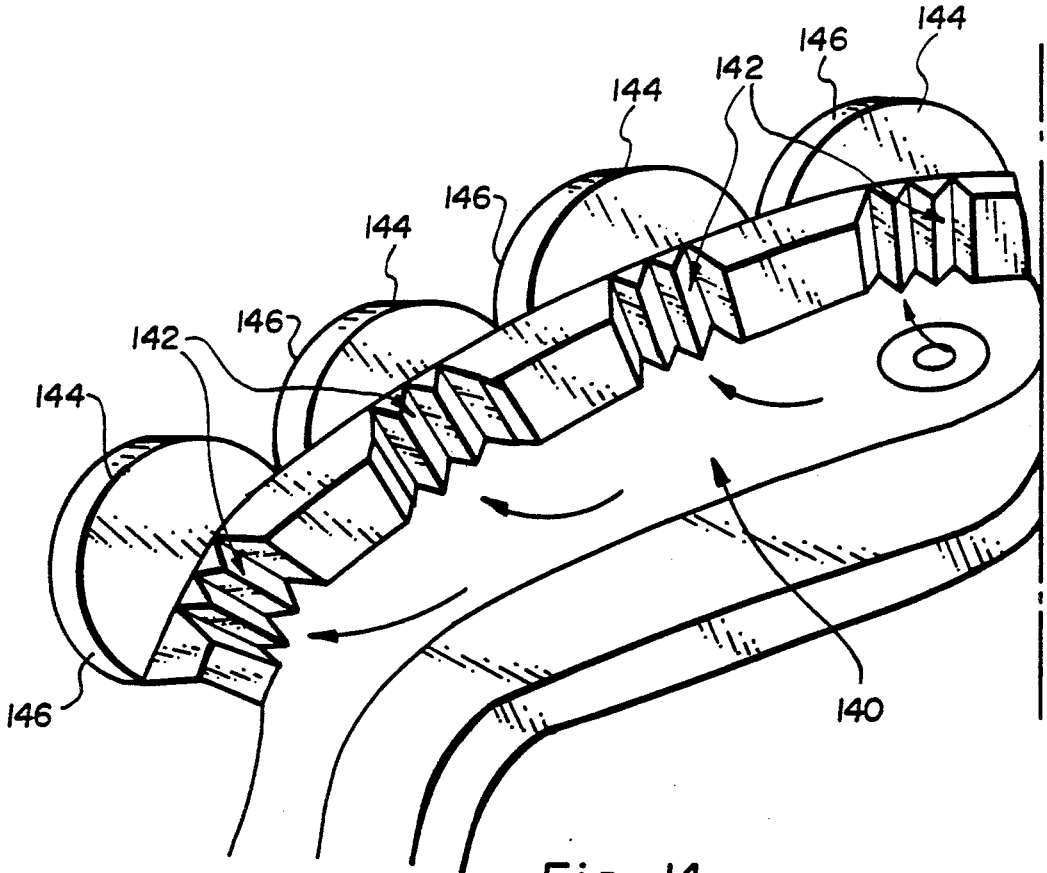
FIG. 14 is a perspective view of a section of a downhole bit and cutter combination designed according to still a further embodiment of the present invention.

A multiple channel design could also be used with the embodiment shown in FIG. 7. Such a multiple channel design is shown in FIG. 14. As seen in FIG. 14, the drilling fluid moving through the fluid course 140 is forced, by the design and contour of the course 140 and due to the centrifugal effect of the rotating bit, against the multiple flow channels 142 which direct the same towards the cutting tip 144 of the respective PDCs 146. Of course, a design similar to that discussed with reference to FIGS. 12 and 13 could also be implemented in this embodiment.

In the foregoing specification, the invention has been described with reference to specific exemplary embodiments thereof. It will, however, be evident that various modifications and changes may be made thereto without departing from the broad spirit and scope of the invention as set forth in the appended claims. The specification and drawings are, accordingly, to be regarded in an illustrative rather than in a restrictive sense.

What is claimed is:

1. A downhole drilling bit and cutter combination, said cutter comprising an upper section and a lower section, said lower section including a cutting tip and said upper section including one or more fluid flow channels, said one or more flow channels focusing the flow of drilling fluid introduced therein towards said cutting tip.

2. The cutter of claim 1, wherein one or more of said one or more flow channels narrows and deepens as it approaches the lower section of said cutter.

3. The cutter of claim 1, wherein said cutter is comprised of polycrystalline diamond material.

4. A method of directing the flow of drilling fluid towards the cutting tip of a downhole drilling bit cutter, said cutter including an upper section, said method comprising the steps of:

spraying drilling fluid at the upper section of said cutter; and directing said fluid spray by means of one or more flow channels in said upper section of said cutter towards said cutting tip.

5. The method of claim 4, wherein said cutter is comprised of polycrystalline diamond material

6. A downhole drilling bit and cutter combination, said drilling bit including a plurality of external drilling fluid courses directing drilling fluid away from the central axis of said bit, each of said courses further including a plurality of flow channels directing said drilling fluid from said course towards the cutting tip of one or more cutters.

7. The combination of claim 6, wherein one or more of said flow channels are comprised of a plow shaped projection into said fluid course and a complementary projection into said fluid course, the two projections channeling drilling fluid towards the cutting tip of one of said cutters.

8. The combination of claim 6, wherein one or more of said flow channels are in the form of a curved contoured channel for accepting drilling fluid from said fluid course and directing said fluid towards the cutting tip of one of said cutters.

9. The combination of claim 6, wherein one or more of said flow channels include a sloping projection and a complementary projection for accepting fluid from said course and directing said fluid towards the cutting tip of one of said cutters.

10. The combination of claim 6, wherein more than one of said plurality of flow channels direct said fluid towards the cutting tip of one of said cutters.

11. The combination of claim 6, wherein said one or more cutters are comprised of polycrystalline diamond material.

12. A method of directing the flow of drilling fluid towards the cutting tip of one or more downhole drilling bit cutters, said drilling bit including one or more external drilling fluid courses directing drilling fluid away from the central axis of said bit and each of said courses further including one or more flow channels connected thereto, said method comprising the steps of:

flowing drilling fluid through one or more of said fluid courses; and directing said fluid from one or more of said fluid courses by means of one or more of said flow channels towards the cutting tip of one or more of said cutters.

13. The method of claim 12, wherein said one or more cutters are comprised of polycrystalline diamond material.

14. A downhole drilling bit and cutter combination, said cutter comprising an upper section and a lower section, said lower section including a cutting tip and said upper section including two or more fluid flow channels, wherein one or more of said flow channels focus the flow of drilling fluid introduced therein towards said cutting tip and one or more of said flow channels direct the flow drilling fluid introduced therein away from said cutter and towards a cutting chip formed when said drilling bit and cutter combination encounters a formation.

15. The cutter of claim 14, wherein said cutter is comprised of polycrystalline diamond material.

16. A downhole drilling bit and cutter combination, said drilling bit including one or more cutters and a plurality of external drilling fluid courses directing drilling fluid away from the central axis of said bit, each of said courses further including two or more flow channels per cutter wherein one or more of said flow channels directs said drilling fluid from said course towards the cutter's cutting tip and one or more of said flow channels directs said drilling fluid from said course away from said cutter towards a cutting chip formed when said downhole drilling bit and cutter combination encounters a formation.

17. The combination of claim 16, wherein said one or more cutters are comprised of polycrystalline diamond material.

18. A method of directing the flow drilling fluid towards the cutting tip of a downhole drilling bit cutter, said cutter including an upper section, said method comprising the steps of:

spraying drilling fluid at the upper section of said cutter; and directing a portion of said fluid spray by means of one or more flow channels in said upper section of said cutter towards said cutting tip and directing a portion of said fluid spray by means of one or more flow channels in said upper section of said cutter away from said cutter.

19. The method of claim 18, wherein said cutter is comprised of polycrystalline diamond material.

20. A method of directing the flow of drilling fluid towards the cutting tip of one or more downhole drilling bit cutters, said drilling bit including one or more external drilling fluid courses directing drilling fluid away from the central axis of said bit and each of said courses further including two or more flow channels per cutter, said method comprising the steps of:

flowing drilling fluid through one or more of said fluid courses;

directing a portion of said fluid from one or more of said fluid courses by means of one or more of said flow channels towards the cutting tip of one or more of said cutters; and directing a portion of said fluid from one or more of said fluid courses by means of one or more of said flow channels away from one or more of said cutters towards a cutting chip formed when said drilling bit cutters encounter a formation.

21. The method of claim 20, wherein said one or more cutters are comprised of polycrystalline diamond material.

* * * * *